US008407816B2

(12) United States Patent
Rhoades, II

(10) Patent No.: US 8,407,816 B2
(45) Date of Patent: Apr. 2, 2013

(54) SECURE POCKET

(75) Inventor: George James Rhoades, II, Tiburon, CA (US)

(73) Assignee: Endless Ammo, Inc., Tiburon, CA (US)

( * ) Notice: Subject to any disclaimer, the term of this patent is extended or adjusted under 35 U.S.C. 154(b) by 89 days.

(21) Appl. No.: 12/857,583

(22) Filed: Aug. 17, 2010

(65) Prior Publication Data

US 2011/0197344 A1 Aug. 18, 2011

Related U.S. Application Data

(60) Provisional application No. 61/234,578, filed on Aug. 17, 2009.

(51) Int. Cl.
*A41D 27/20* (2006.01)
*A41D 27/00* (2006.01)

(52) U.S. Cl. ..... 2/253; 2/247; 2/251; 2/252

(58) Field of Classification Search ..... 2/247–254
See application file for complete search history.

(56) References Cited

U.S. PATENT DOCUMENTS 149,358 A * 4/1874 Tapley ..... 211/42
915,557 A * 3/1909 Cooper ..... 43/57.1
1,574,077 A * 2/1926 Frantz ..... 2/252
1,574,127 A * 2/1926 Siegel ..... 2/93
1,669,791 A * 5/1928 Stocks ..... 383/85
1,734,642 A * 11/1929 Olm ..... 229/67.3
1,764,483 A * 6/1930 Watkins ..... 2/247
1,781,816 A * 11/1930 Jovino ..... 224/223
1,787,791 A * 1/1931 May ..... 206/214
2,218,228 A * 10/1940 Yagodnik ..... 2/254
2,235,848 A 3/1941 Reis
2,324,154 A * 7/1943 Haney ..... 2/94
2,336,248 A 12/1943 Harwood
2,369,208 A * 2/1945 Brangaccio ..... 2/247
2,778,026 A 1/1957 Rosenthal
2,931,558 A * 4/1960 Zalkind ..... 229/72
2,968,813 A * 1/1961 Bacharach ..... 2/248
3,073,508 A * 1/1963 Hiersteiner ..... 229/67.3
3,118,478 A * 1/1964 Metrick ..... 150/136
3,128,514 A * 4/1964 Parker et al. ..... 24/11 HC
3,229,849 A * 1/1966 Spillson ..... 206/179
3,371,829 A * 3/1968 Phillips ..... 224/230
3,381,888 A * 5/1968 Lewis, Jr. et al. ..... 229/72
3,451,065 A * 6/1969 Werner ..... 2/247
3,619,817 A * 11/1971 Rockwell ..... 2/250
3,719,319 A * 3/1973 Schleutermann et al. ..... 229/72
3,747,776 A * 7/1973 Gross ..... 206/527
3,759,305 A * 9/1973 McIntyre ..... 150/149
3,792,543 A * 2/1974 Powell ..... 40/800
3,994,328 A * 11/1976 Reis ..... 150/143
4,047,650 A * 9/1977 Domingos ..... 224/223
4,119,249 A * 10/1978 Hanson ..... 224/236
4,138,745 A * 2/1979 Greenspan ..... 2/247
4,139,914 A * 2/1979 Tarr ..... 2/247
4,156,293 A * 5/1979 Off ..... 2/247
4,174,793 A * 11/1979 Wisowaty ..... 224/240
4,174,798 A * 11/1979 Pollard ..... 224/674
4,321,710 A * 3/1982 Off ..... 2/247
4,525,879 A * 7/1985 Kalomeris ..... 2/338
4,705,086 A * 11/1987 O'Neill ..... 150/134

(Continued)

*Primary Examiner* — Bobby Muromoto, Jr.
(74) *Attorney, Agent, or Firm* — Jonathan P. Kudla

(57) ABSTRACT

An exemplary embodiment provides for a secure pocket that includes a backing, an inner-lower panel coupled to the backing and an upper-outer panel flap coupled to the backing. The upper-outer panel flap overlaps a portion of a circumference of the inner-lower panel and an inner-lower panel opening is covered by the upper-outer panel flap.

12 Claims, 3 Drawing Sheets

U.S. PATENT DOCUMENTS 4,819,846 A * 4/1989 Hannemann ..... 224/240
4,923,105 A * 5/1990 Snyder ..... 224/255
5,031,763 A * 7/1991 Lynam ..... 206/214
5,063,614 A * 11/1991 McSheffery ..... 2/94
5,072,456 A * 12/1991 Elin ..... 2/94
5,165,115 A * 11/1992 Stanislaw ..... 2/247
5,267,645 A * 12/1993 Tokunaga et al. ..... 206/188
5,462,160 A * 10/1995 Youngs ..... 206/312
5,509,147 A * 4/1996 Busquets ..... 2/253
5,588,385 A * 12/1996 Sand ..... 112/475.09
5,588,527 A * 12/1996 Youngs ..... 206/308.1
5,678,754 A * 10/1997 Kranz ..... 229/72
5,752,589 A * 5/1998 Berg ..... 190/109
5,799,336 A * 9/1998 Cooper ..... 2/247
5,806,236 A * 9/1998 Lloyd ..... 43/57.1
5,809,576 A * 9/1998 Huston et al. ..... 2/247
5,832,536 A 11/1998 Kramer
5,984,167 A * 11/1999 Roccaforte ..... 229/84
6,000,064 A 12/1999 Alcone
D419,282 S * 1/2000 Nickle et al. ..... D2/891
6,125,616 A * 10/2000 Brown ..... 54/66
6,131,198 A * 10/2000 Westrick ..... 2/102
D438,008 S * 2/2001 Snider ..... D3/299
D439,047 S * 3/2001 Holland et al. ..... D3/299
D442,781 S * 5/2001 Snider ..... D3/299
6,244,485 B1 * 6/2001 Holland et al. ..... 224/584
6,244,486 B1 * 6/2001 Holland et al. ..... 224/584
D449,443 S * 10/2001 Snider ..... D3/299
6,415,450 B1 7/2002 Lien
6,415,529 B1 * 7/2002 Kelley ..... 36/3 R
6,557,183 B1 5/2003 Truong
6,651,854 B1 * 11/2003 LaCoste ..... 224/196
6,691,906 B2 * 2/2004 Cragg ..... 224/238
6,851,600 B1 * 2/2005 Fus, Sr. ..... 229/72
6,899,257 B2 * 5/2005 Jones ..... 224/680
6,926,182 B2 * 8/2005 Cragg ..... 224/238
7,075,798 B2 * 7/2006 Hendrickson ..... 361/818
7,172,107 B2 * 2/2007 Kranz ..... 229/68.1
7,231,672 B2 6/2007 Thomas
D574,608 S * 8/2008 Menzel et al. ..... D3/215
D574,610 S * 8/2008 Garrett ..... D3/228
7,644,449 B2 * 1/2010 Hellweg ..... 2/247
7,651,016 B2 * 1/2010 Stewart ..... 224/577
7,784,109 B2 * 8/2010 Seguin et al. ..... 2/93
D623,852 S * 9/2010 Kroll ..... D3/226
2002/0157170 A1 * 10/2002 Lipscher ..... 2/250
2003/0205490 A1 * 11/2003 Brock ..... 206/232
2004/0020959 A1 * 2/2004 Sellars ..... 224/675
2005/0235398 A1 10/2005 Yoo
2006/0011687 A1 * 1/2006 Wadley et al. ..... 224/587
2006/0253963 A1 * 11/2006 Limbaugh ..... 2/247
2007/0000030 A1 1/2007 Toomey
2007/0107111 A1 * 5/2007 Passman ..... 2/247
2007/0180596 A1 * 8/2007 Shelton ..... 2/113
2007/0245444 A1 * 10/2007 Brink ..... 2/69
2007/0246389 A1 * 10/2007 Marcello ..... 206/472
2008/0029409 A1 * 2/2008 Antler ..... 206/63.5
2009/0014344 A1 * 1/2009 Altman et al. ..... 206/307.1
2009/0031467 A1 * 2/2009 Swindells et al. ..... 2/51
2010/0044249 A1 * 2/2010 Holden ..... 206/37
2010/0077531 A1 * 4/2010 Sale ..... 2/144
2010/0088795 A1 * 4/2010 Simione ..... 2/24
2012/0055963 A1 * 3/2012 Phair ..... 224/267

* cited by examiner

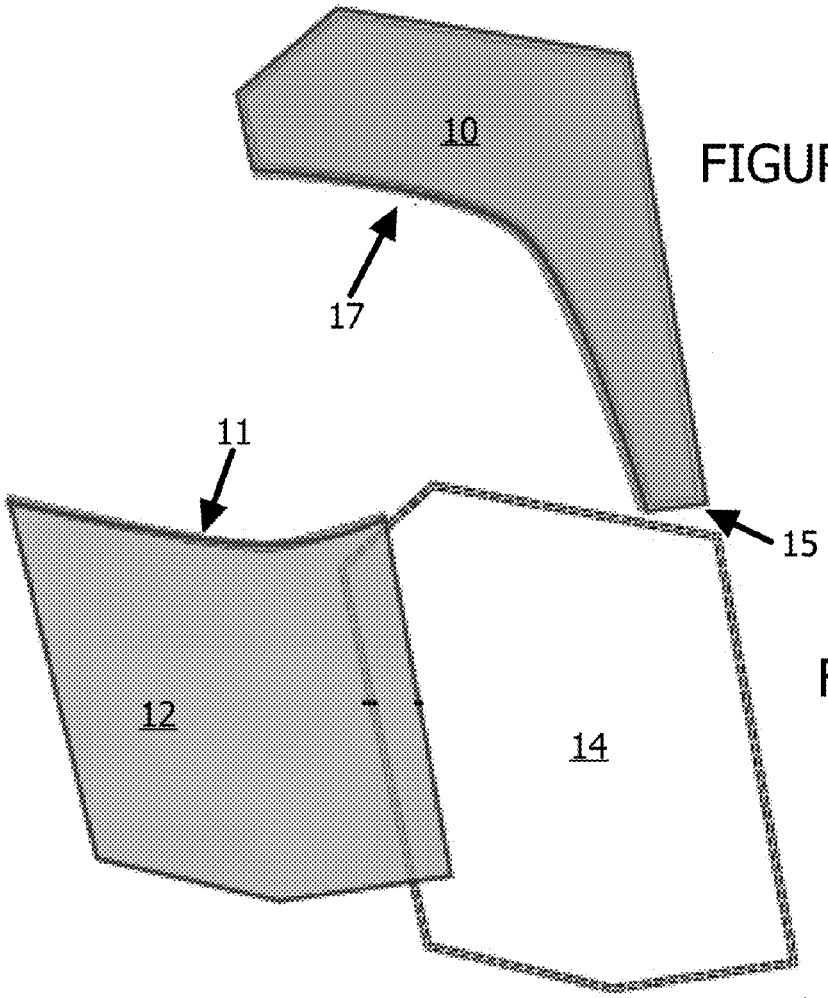
FIGURE 1A
FIGURE 1B
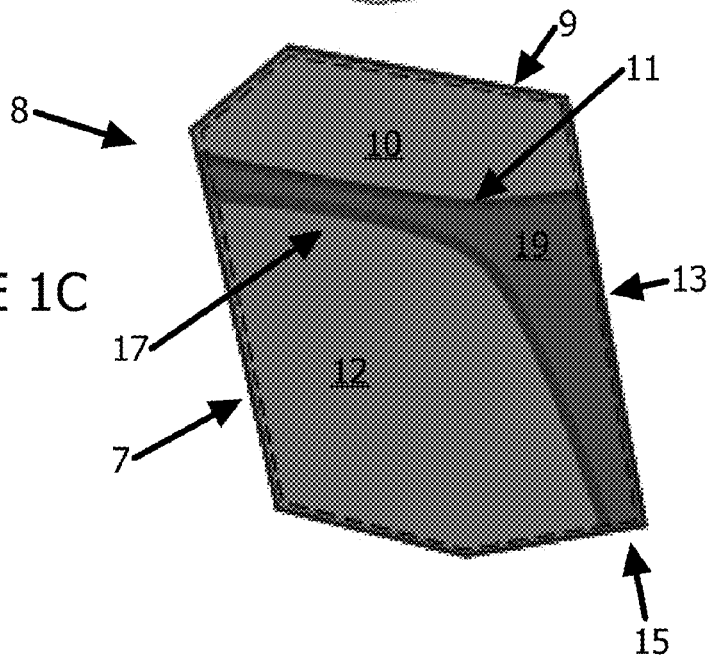
FIGURE 1C

FIGURE 3
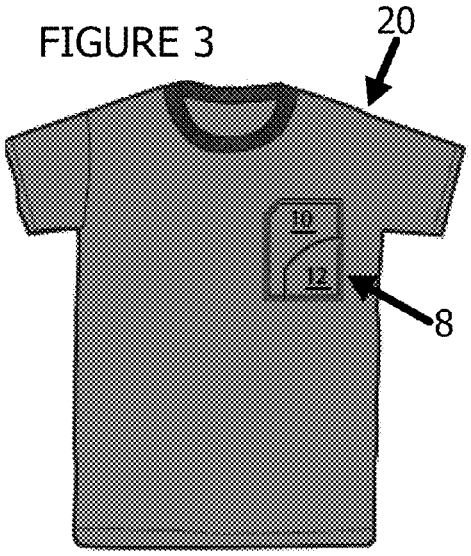
FIGURE 4
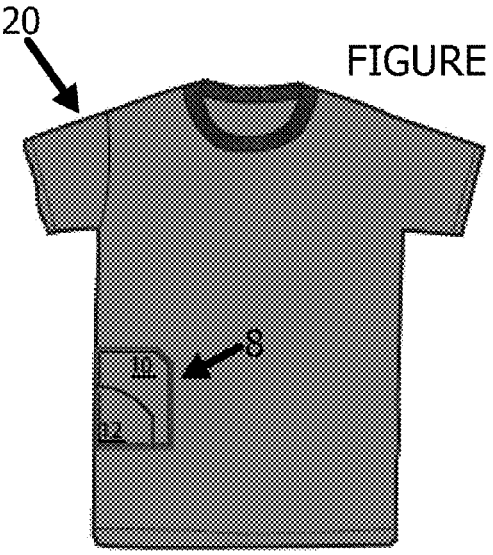
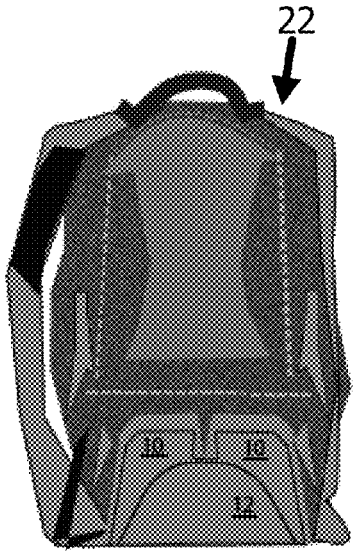
FIGURE 5
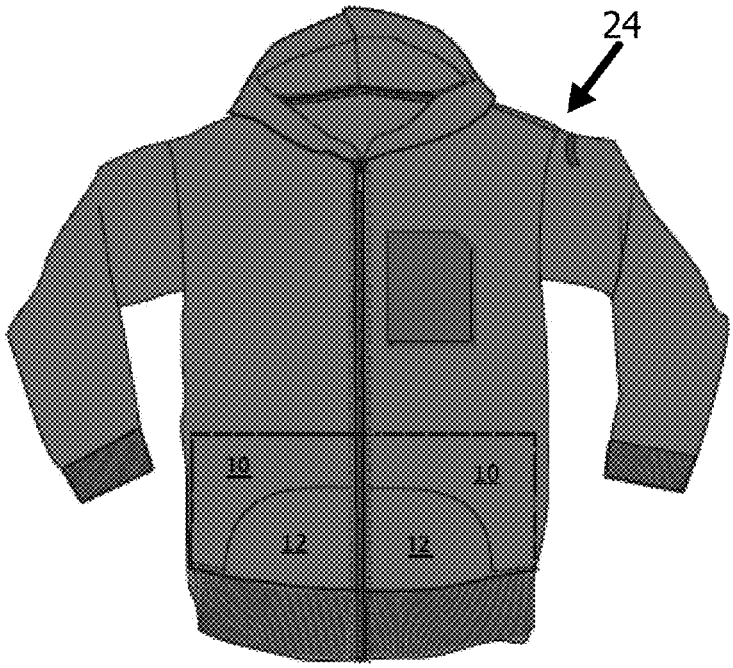
FIGURE 6

SECURE POCKET

PRIORITY STATEMENT

The present application hereby claims the benefit of priority of U.S. Provisional Patent Application Ser. No. 61/234,578, filed on Aug. 17, 2009, entitled "Secure Fastener Free Pocket," and is herein incorporated by reference.

BACKGROUND

Pockets are commonplace in virtually all types of attire. Typical pockets have an un-securable opening for easy insertion and extraction of objects. Pockets may also include a flap over the opening to prevent objects from falling out. The flap may also be further secured via the addition of a zipper, fasteners, hooks and loops, etc. to secure the flap a pocket base.

While a secured flap has been in use for a long time, significant improvements in pocket security have not occurred. Due to this, new designs for secure pockets are desirable.

The foregoing examples of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

The claimed embodiments provide for a pocket that includes a backing, an inner-lower panel coupled to the backing and an upper-outer panel flap coupled to the backing. The upper-outer panel flap overlaps a portion of a circumference of the inner-lower panel and an inner-lower panel opening is covered by the upper-outer panel flap.

In another implementation, the claimed embodiments also provide for a secure pocket that includes a backing, an upper-outer panel flap and an inner-lower panel coupled to the backing. The upper-outer panel flap is partly coupled to the backing and partly coupled to the inner-lower panel. Also, an inner-lower panel opening is covered by the upper-outer panel flap.

In yet another implementation, the claimed embodiments provide for a secure pocket that includes a backing, an upper-outer panel flap and an inner-lower panel coupled to the backing. The upper-outer panel flap overlaps a portion of a circumference of the inner-lower panel. Also, the upper-outer panel flap is partly coupled to the backing and partly coupled to the inner-lower panel. Furthermore, an inner-lower panel opening is covered by the upper-outer panel flap.

In addition to the exemplary aspects and embodiments described above, further aspects and embodiments will become apparent by reference to the drawings and by study of the following descriptions.

BRIEF DESCRIPTION OF THE DRAWINGS

Exemplary embodiments are illustrated in referenced figures of the drawings. It is intended that the embodiments and figures disclosed herein are to be considered illustrative rather than limiting.

FIGS. 1A-1B illustrate parts of a pocket, in accordance with an exemplary embodiment;

FIG. 1C illustrates the assembled parts of the pocket shown in FIGS. 1A-1B, in accordance with an exemplary embodiment;

FIGS. 3-4 illustrate example placement of the pocket on a t-shirt, in accordance with an exemplary embodiment;

FIG. 5 illustrates placement of the pocket on a backpack, in accordance with exemplary embodiment; and FIG. 6 illustrates placement of the pocket on a jacket, in accordance with an exemplary embodiment.

DETAILED DESCRIPTION

Figure 2:
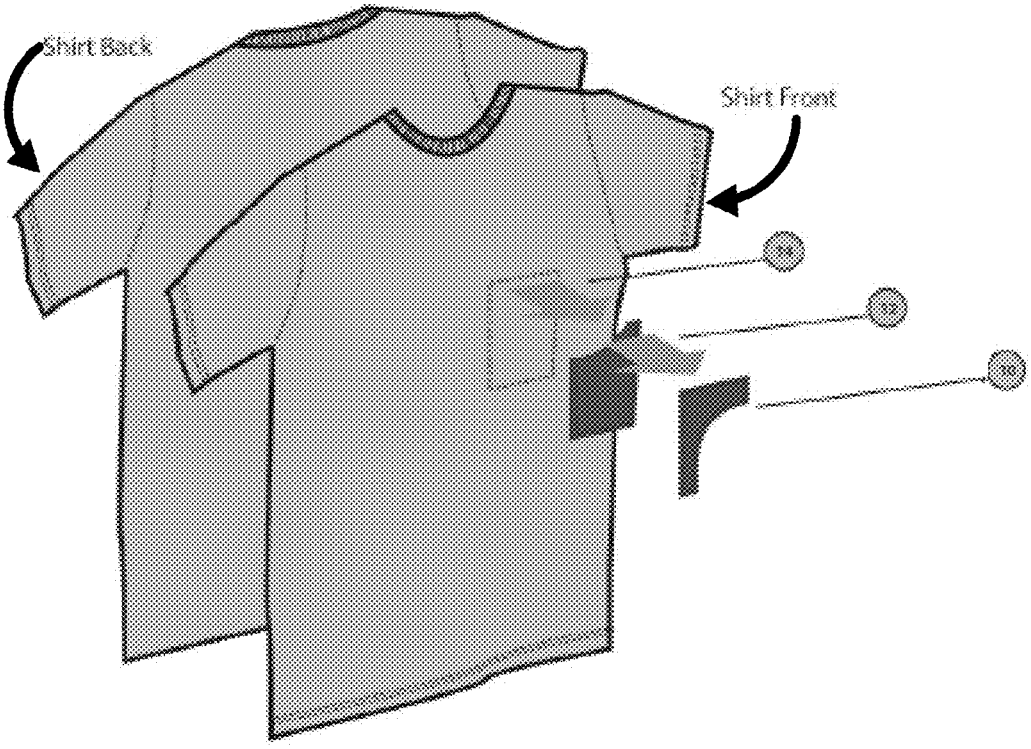
FIG. 2 illustrates an unassembled shirt and pocket, in accordance with an exemplary embodiment.

The claimed embodiments provide for a secure, self-sealing pocket with or without the use of hardware fasteners. Once an inserted hand is removed from the pocket, a flap of the pocket closes automatically. When using pockets of the prior art, a person usually needs to be cognizant to snap or close a button. Prior art pockets also allow items to fall out if no fastener is present or if the fastener is not fastened. The claimed embodiments provide for silent operation of a securely retentive pocket without fasteners. A pocket of the claimed embodiments closes without cognizant thought through the use of over-locking, opposed concavely-shaped panels. These panels are anchored around an outside periphery of the pocket and un-sealed at their opposing concavely-shaped edges.

In reference to FIGS. 1A-1B which illustrate parts of a pocket 8 and FIG. 1C which illustrates the assembled parts of the pocket 8 shown in FIGS. 1A-1B, an upper-outer panel flap 10 is anchored to an inner-lower panel 12 and a backing 14 thus sealing a top 9 and a side 7 of the pocket 8. The upper outer panel flap 10 is also partially anchored on a portion of a bottom 15 of the pocket 8 and at a side 13 of the pocket 8. The upper-outer panel flap 10 has a concavely-shaped lower open edge 17 to create an overlap 19 opposing the inner-lower panel 12. The inner-lower panel 12 is anchored to the backing 14 on sides 7, 13 and at bottom 15. The inner-lower panel 12 has a concavely-shaped top open edge 11. The backing 14 provides a foundation for the pocket 8 to encapsulate contents without requiring the use of fasteners for the contents to be secure. While edges 11 and 17 are concavely-shaped, the claimed embodiments are not necessarily limited to a concave shape.

It will be appreciated by those of skill in the art that the phrases 'upper-outer panel flap' and 'inner-lower panel' are merely illustrative and not meant to limit various implementations of the claimed embodiments.

To create the claimed embodiments, panels may be constructed in a variety of shapes and from a variety of resilient fabrics to enable a reflexively sealing pocket on a plurality of surface backings. A user of the pocket 8 may insert a hand or an object between the upper-outer panel flap 10 and the concavely-shaped lower open edge 17 thereby transversely penetrating the inner-lower panel 12 via the concavely-shaped top open edge 11. The upper-outer panel flap 10 diametrically overlaps the inner-lower panel pocket 12 to provide security for the pocket 8 thereby preventing ejection of pocket contents. While edges 11 and 17 are concavely-shaped, other shapes may be utilized.

Pockets of the claimed embodiments may be constructed from a variety of fabrics and materials that are waterproof, fireproof, melt-resistant, wicking, etc and combinations thereof. The pocket may be fabricated in numerous shapes and sizes and can be deployed on a variety of different item sizes. The pocket 8 may be used inside or outside of numerous types of backing materials. The backing materials may also be, for example, waterproof, fireproof, melt-resistant, wicking, etc and combinations thereof.

Pockets may be attached to numerous types of vehicles including shirts, shorts, packets, pants, saddles, hats, etc. The pocket 8 may also further include fasteners as a method of reinforcement. Example use of the pocket 8 on a t-shirt 20, a backpack 22 and a jacket 24 is shown in FIGS. 3-6.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A secure pocket comprising:
a backing;
an inner-lower panel coupled to the backing;
an upper-outer panel flap coupled to the backing;
wherein the upper-outer panel flap overlaps a portion of a circumference of the inner-lower panel;
wherein an inner-lower panel opening is covered by the upper-outer panel flap; and
wherein both ends of an upper-outer panel flap opening are each located at corresponding beginnings of upper-outer panel flap edge sections coupled to inner lower panel flap edge sections coupled to the backing.

2. The secure pocket as recited in claim 1 wherein the inner-lower panel opening is concavely-shaped.

3. The secure pocket as recited in claim 1 wherein an upper-outer panel flap opening is concavely-shaped.

4. The secure pocket as recited in claim 1 wherein the inner-lower panel opening is concavely-shaped and an upper-outer panel flap opening is concavely-shaped.

5. A secure pocket comprising:
a backing;
an upper-outer panel flap;
an inner-lower panel coupled to the backing;
wherein the upper-outer panel flap is partly coupled to the backing and partly coupled to the inner-lower panel;
wherein an inner-lower panel opening is covered by the upper-outer panel flap; and
wherein both ends of an upper-outer panel flap opening are each located at corresponding beginnings of upper-outer panel flap edge sections coupled to inner lower panel flap edge sections coupled to the backing.

6. The secure pocket as recited in claim 5 wherein the inner-lower panel opening is concavely-shaped.

7. The secure pocket as recited in claim 5 wherein an upper-outer panel flap opening is concavely-shaped.

8. The secure pocket as recited in claim 5 wherein the inner-lower panel opening is concavely-shaped and an upper-outer panel flap opening is concavely-shaped.

9. A secure pocket comprising:
a backing;
an upper-outer panel flap;
an inner-lower panel coupled to the backing;
wherein the upper-outer panel flap overlaps a portion of a circumference of the inner-lower panel
wherein the upper-outer panel flap is partly coupled to the backing and partly coupled to the inner-lower panel;
wherein an inner-lower panel opening is covered by the upper-outer panel flap;
wherein both ends of an upper-outer panel flap opening are each located at corresponding beginnings of upper-outer panel flap edge sections coupled to inner lower panel flap edge sections coupled to the backing.

10. The secure pocket as recited in claim 9 wherein the inner-lower panel opening is concavely-shaped.

11. The secure pocket as recited in claim 9 wherein an upper-outer panel flap opening is concavely-shaped.

12. The secure pocket as recited in claim 9 wherein the inner-lower panel opening is concavely-shaped and an upper-outer panel flap opening is concavely-shaped.

* * * * *